United States Patent [19]

Schwind

[11] 4,348,750

[45] Sep. 7, 1982

[54] ENERGY CONTROL DEVICE

[76] Inventor: David R. Schwind, 557 Peralta Ave., San Francisco, Calif. 94110

[21] Appl. No.: 64,067

[22] Filed: Aug. 6, 1979

[51] Int. Cl.[3] ..... H04R 23/00

[52] U.S. Cl. ..... 367/140; 367/151; 376/104; 181/155; 181/195; 350/294; 179/1 MF

[58] Field of Search ..... 179/1 MF, 115.5 R; 181/155, 195, 175, 176; 367/151, 140; 350/294, 299; 176/1

[56] References Cited

U.S. PATENT DOCUMENTS

| | | | |
|---|---|---|---|
| 2,064,911 | 12/1936 | Hayes | 367/151 |
| 2,135,840 | 11/1938 | Pfister | 181/176 |
| 2,534,543 | 12/1950 | Bullock | 350/294 |
| 2,891,437 | 6/1959 | Tripp | 350/294 |
| 2,943,296 | 6/1960 | Fryklund | 367/151 |
| 3,085,565 | 4/1963 | McCauley | 350/294 |
| 3,424,873 | 1/1969 | Walsh | 179/115.5 R |
| 4,118,274 | 10/1978 | Bakken | 176/1 |
| 4,146,869 | 3/1979 | Snyder | 181/155 |
| 4,158,598 | 6/1979 | Baird | 176/1 |
| 4,225,010 | 9/1980 | Smith | 181/155 |

FOREIGN PATENT DOCUMENTS

| | | | |
|---|---|---|---|
| 2041906 | 8/1970 | Fed. Rep. of Germany | 181/155 |
| 2325603 | 5/1974 | Fed. Rep. of Germany | 181/155 |

*Primary Examiner*—Harvey E. Behrend

*Attorney, Agent, or Firm*—Woodard, Weikart, Emhardt & Naughton

[57] ABSTRACT

First and second reflectors, having a parabolic concave reflective surface and a conical reflecting surface, respectively, are vertically spaced on co-linear axis. An energy source, such as a loudspeaker mounted atop the frusto-conical second reflector near the apex of the conical reflective surface thereof is at or proximate the focal point of the concave reflective surface of the parabolic reflector. It is desirable for the major diameters of the reflectors to be approximately twice the wavelength of the lowest frequency sound for which the device is applicable. The shapes of the reflective surfaces are established to provide essentially equal path lengths of energy radiated from the source to a wave front to provide coherent omnidirectional energy propagation from the assembly or, in an alternative use of the apparatus, receive radiant energy and focus it on target instead of a loudspeaker at the focal point of the parabolic reflective surface.

4 Claims, 6 Drawing Figures

ENERGY CONTROL DEVICE

BACKGROUND OF THE INVENTION

1. Field of the Invention

This invention relates generally to radiant energy, and more particularly to a device for establishing desired pattern of radiation in space from a centralized source or; for concentrating at a point, radiating energy from a plurality of sources.

2. Description of the Prior Art

The present invention is normally used in conjunction with a cabinet mounted loudspeaker and an electrical frequency dividing network, in order to reproduce the entire audible sound spectrum. The human ear's perception of direction is most sensitive to high frequency sound. In a room the human ear normally has difficulty distinguishing the location or direction of low frequency sound. This is particularly true in the reverberant sound field where one would normally listen to a loudspeaker. This invention is intended to control the directionality of that part of the sound spectrum in which the ear is most sensitive.

The most pertinent prior art known to me is a so-called coherent-sound loudspeaker such as described in U.S. Pat. No. 3,424,873 issued Jan. 28, 1969 to Lincoln Walsh. That particular loudspeaker has evolved somewhat. In addition, Bruel and Kjaer manufactures the type 4241 isotropic sound source which employs twelve loudspeaker drivers mountedin a single enclosure. Both loudspeakers are suitable for creating a diffuse sound field suitable for performing indoor acoustical tests. Yet I understand that they remain fairly expensive, and there remains a need for an omni-directional loudspeaker assembly of less expensive construction capable of creating a diffuse sound field. The present invention is addressed to that need. A diffuse sound field is normally required to quantify the degree of sound absorption provided by the room boundaries and contents and quantify the degree of sound isolation between barriers separating architectural spaces.

SUMMARY OF THE INVENTION

Described briefly, according to a typical embodiment of the present invention, there is a first reflector and a second reflector. The first reflector is of substantially parabolic shape, and a source of radiant energy is located proximate the focal point of the first reflector. Radiant energy from the source onto the reflective surface of the first reflector is then reflected onto a reflective surface of the second reflector, from which it is radiated outward with respect to an axis of symmetry of the second reflector. The angle between the axis of symmetry and the radiated energy's direction of propagation is selectable. Means can be provided to establish a desired directivity of the radiant energy reflected from the second reflector. By reciprocity the apparatus may also be used to concentrate at said focal point, radiant energy received from sources surrounding the apparatus.

DESCRIPTION OF THE PREFERRED EMBODIMENT

Figure 1:
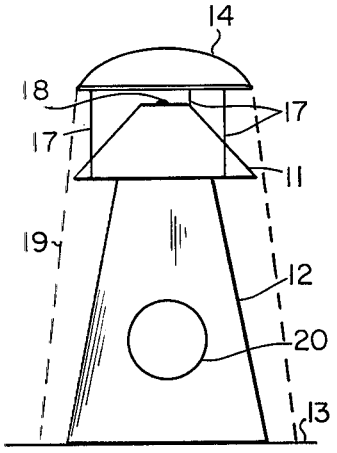
FIG. 1 is an elevational view of an energy control device according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the illustrated embodiment of the devices includes a conical reflector 11 mounted resiliently on springs 15 supported by a cabinet 12 which may rest upon a floor 13. A parabolic reflector member 14 is disposed over the cone and may be rigidly supported from the conical reflector 11 by slender metal rods 17. The springs are deflected by the weight of the reflectors transmitted through brackets 15A to housing 12 in order to vibration isolate the assembly from low frequencies generated by a loudspeaker 20 mounted in cabinet 12. Other means may be employed for suspending the parabolic reflector and the conical reflector, such as with wire from the ceiling. An energy source 18 is mounted atop the conical reflector member. A decorative housing may be provided as indicated by the dotted lines 19, if desired. Such housing may also be secured to establish the spatial relationship between the two reflector members 11 and 14.

Figure 2:
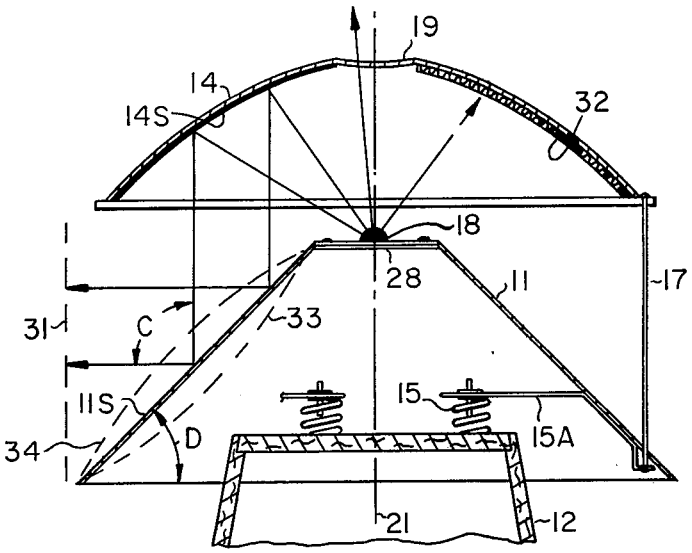
FIG. 2 is a vertical section containing the central axis of the assembly.

Referring now to FIG. 2, which is a section through the two reflector members taken on a vertical plane containing their axes, they should be understood to be symmetrical with respect to the common axis 21. Each of these reflector members is a rigid member, in the sense that it is not expected that the material of the member itself be deformed in response to impingement of radiant energy thereon, for subsequent resilient relay or amplification of such radiant energy. Instead, the outer convex surface of the conical member and designated 11S is a reflective material. Similarly, the outer concave surface 14S of member 14 is of a reflective material. These surfaces are intended to reflect radiant energy. The strength and suitable reflective qualities can be obtained in 26 gauge aluminum, with a damping compound all over the inner concave surface of the cone. The energy is to be reflected from the reflective surfaces such that the angle of incidence is equal to the angle of reflection. This will be better recognized upon reference to FIG. 3.

Figure 3:
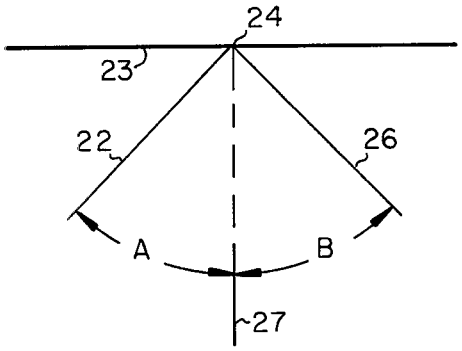
FIG. 3 is an illustrative diagram.

In FIG. 3, an incident ray 22 impinging upon a reflective surface 23 at an angle of incidence "A" is reflected at point 24 into reflected ray 26 at an angle "B" of reflected energy which is equal to the angle "A" of incident energy. These angles are measured with respect to a line 27 normal to the reflective surface at the point of incidence of the incident ray.

Referring again to FIG. 2, the energy source 18 can be a sound energy source such as a "dome tweeter" loudspeaker. A KEF T27 speaker has been found suitable. The tweeter is mounted over a central aperture 28 in the top of the reflector member 11. Thus, the source of the radiant energy in this instance is centrally located on the co-linear axes of the two reflectors. Also it is at the focal point of the parabolic reflector surface 14S of reflector member 14. A small circular opening 19, has been provided in the center of reflector member 14, to prevent flutter echoes between the "dome tweeter" and reflector member 14. The circular opening 19 allows a small portion of the sound energy to travel upward, increasing sound diffusion. The result is that most of the energy radiated from the source 18 is reflected from the surface 14S along lines parallel to the axis 21 and onto the reflective surface 11S of the reflector member 11. From there it is reflected radially outward perpendicular to axis 21 for 360° around the axis.

Again referring to FIG. 2 the angle "C" is between an imaginary line parallel to axis 21 and the energy reflected radially with respect to axis 21. The angle "D" is between an imaginary line perpendicular to the normal of reflector surface 11S and the normal of axis 21. The angle "C" of the radially reflected energy with respect to axis 21 can be decreased by decreasing the conical reflector angle "D". Similarly angle "C" can be increased by increasing angle "D". The result is increasing angle "D" tilts the overall radiation pattern downward with respect to the assembly, while decreasing angle "D" tilts it upward. However it remains possible to change angle "C" of the radially reflected energy with respect to axis 21 without changing angle "D"; this can be accomplished by altering the spatial relationship between the parabolic reflector member 14 and the conical reflector member 11 while maintaining symmetry about axis 21. In order to decrease angle "C" the distance between the reflector members 11 and 14 can be increased along axis 21. This adjustment moves the energy source 18 further from the parabolic reflector member 14 and beyond the focal point. The rays of energy reflected from member 14 are not parallel, but are angularly distributed about axis 21 such that they converge. The result is the angle of incidence with reflector surface 11S is decreased, thus the angle of reflection is decreased and the overall radiation pattern from the assembly tilts upward.

Similarly, in order to increase angle "C" without changing angle "D", the distance between the reflector members 11 and 14 can be decreased along axis 21. This adjustment moves the energy source 18 closer to the parabolic reflector member 14. The rays of energy reflected from member 14 are not parallel, but are angularly distributed about axis 21 such that they diverge. The result is the angle of incidence with reflector surface 11S is increased, thus the angle of reflection is increased and the overall radiation pattern from the assembly tilts downward. The desired limits of the variation in the spatial relationship between the parabolic reflector member 14 and the conical reflector member 11, along axis 21, are plus or minus one third the parabolic reflector's focal length from the focal point.

The distance between reflector members 11 and 14, the angle "D" of conical reflector member 11, concave 33, linear, and convex 34 shape of surface 11S are the variables which can be optimized such that the air path distances of the radiant energy emitted at different angles from the source 18 are matched so the distance the radiant energy must travel are equal from the source to the propagating wave front of energy. The three dimensional wave-front shape propagating away from the assembly can be cylindrical, convergent, divergent or conical.

Illustrating this feature and referring to FIG. 2 the shape of the parabola and cone are matched so that the air path distance of the radiant energy from the source to the surface 14S and then to the surface 11S and then to an imaginary cylinder 31 having a diameter equal to the outermost diameter of the conical reflective surface 11S, is equal for all rays of energy from the source. This results in the effect of the energy from the source being radiated coherently from a cylinder of a height equal to the height of the frusto-conical reflector as measured parallel to the axis 21, and for 360°.

Figure 4:
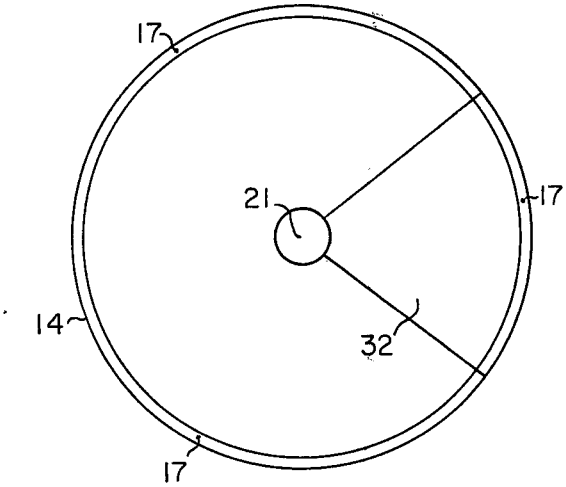
FIG. 4 is a bottom view of a parabolic reflector of the assembly.

It is desirable for the major diameters of the reflectors to be approximately twice the wave-length of the lowest frequency sound for which the device is applicable. If it is desired to have directional, rather than omnidirectional propagation of energy from the second reflector 11S, an energy absorbent material can be provided either on the surface of reflector 14 or reflector 11. As an example, as shown in FIG. 4, a sector 32 of sound absorbing material can be provided on the inner surface of reflecting member 14 to absorb energy radiated from the source through approximately 45° of index with respect to the central axis 21 of the reflector member. Therefore there will be much less radiation of energy from that portion of the upper reflector to the lower reflector and threfore much less horizontal radiation for approximately 45° of the index. The same effect can be achieved by putting the sound absorbing material on the reflective surface of the second reflector. Also, if some attenuation but not complete absorption is desired, the amount and type of material employed can be varied, as well as its location. Also, additional sectors or segments could be provided with absorbing material to obtain various desired effects.

The aforementioned Walsh patent speaks of coherent sound. By establishing the same air path lengths of propagation of energy from the source essentially at the focal point of the parabolic reflector, to the imaginary cylinder 31, the coherent sound can be achieved. If it should happen that the source itself provided non-coherent sound, it is conceivable that the shape of either the parabolic or conical reflector could be varied to provide coherent sound radiation from the assembly. For example, the second reflector could be provided with a surface curved something as indicated by the dotted outline 33 in FIG. 2, if desired.

Figure 5:
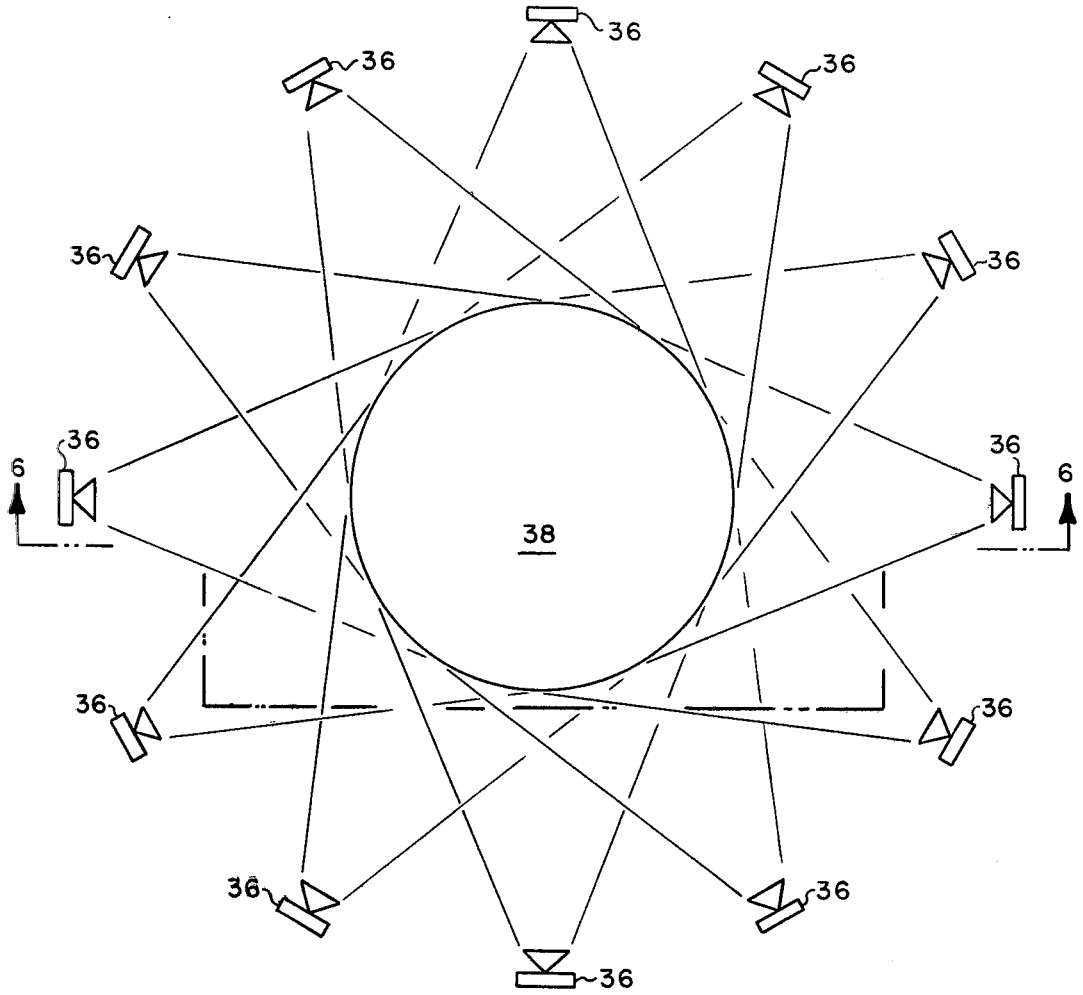
FIG. 5 is a plan view of an array of circularly spaced energy sources with the energy control device employed as a concentrator.
Figure 6:
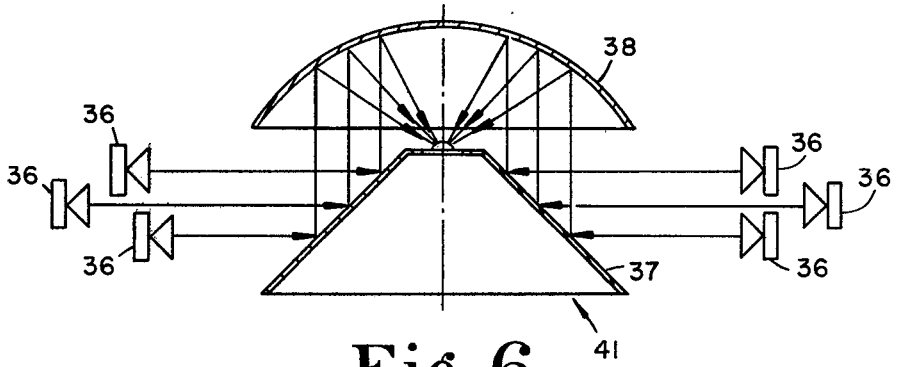
FIG. 6 is a section through the array of FIG. 5 taken at line 6—6 in FIG. 5 and viewed in the direction of the arrows.

The present invention may also be used to focus energy at the focal point of the parabolic reflector. In such instance, instead of the energy source at the focal point, a plurality of energy sources may be deployed in an array. An example is in FIGS. 5 and 6 where radiant energy sources 36 are displayed in a circular array about the axis 35 of the assembly and direct energy horizontally onto the reflecting cone surface 37. From there it is reflected to the parabolic reflector 38 and from there to the target 39 atop the frusto conical member 41 at the focal point of the parabolic reflector. The sources 36 can be lasers, and the target a deuterium-tritium fuel pellet. Typically the lasers might be neodymium-glass or phosphate-glass and the reflector mirrors or active-mirror amplifiers. The mirrors can be flat, such that when their centroids are connected by imaginary circular lines, they describe parabolic and conical surfaces.

Active mirror amplifier here is taken to mean a device which consists of laser glass having a dielectric coating on its surface allowing light to be transmitted from an array of flash tubes on its back surface, and the reflection of laser light. The purpose is to focus energy to establish a high level of energy from a plurality of comparatively lower energy level sources to cause a thermo-nuclear burn.

In another application the sources 36 can be loudspeakers, with the purpose of exposing a small prototype or substrate to extremely high sound pressure levels.

From the foregoing description, it should be recognized that the present invention could be applied to radiant energy other than sound. It should be understood, therefore, that the appendant claims should be considered to encompass utilization of the inventive concepts herein for the control of energy in radiant forms other than sound energy only.

What is claimed is:

1. A radiant energy control device to control dispersion of radiant energy is 360° comprised of:

a first reflector having a concave parabolic reflecting surface symmetrical about an axis which contains the focal point;

a second reflector having an outer reflecting surface which is conical and converges toward the first reflector and which is symmetrical about an extension of said axis and oriented to effect a change of direction of radiant energy between a direction parallel to said axis extension and directions radial to said axis extension, and oriented for the reflection of energy between said first and second reflecting surfaces;

a source of radiant energy positioned on the second reflector and mounted symmetrically along said axis, said source being directional and radiating energy that substantially propagates from said source along straight lines as rays toward the concave reflecting surface of the first reflector for reflection from said first reflector substantially parallel to said axis and onto said second reflector.

2. The device of claim 1 wherein:

the said source is located at the focal point of the said first reflector, and said second reflector has straight conical sides angled 45° relative to the said axis of symmetry whereby a majority of the radiant energy dispersed from the device is perpendicular to the said axis of symmetry and forms a phase-coherent cylindrical plane wave front.

3. The device of claim 2 wherein:

said source is a loudspeaker; and said second reflector is frustoconical, with said loudspeaker mounted at the top of the frustum of the cone.

4. The device of claim 2 and further comprising:

a cabinet;

springs atop said cabinet;

said second reflector being mounted over said cabinet on said springs;

said second reflector having support means extending upward therefrom; and said first reflector being mounted over said second reflector on said support means.

* * * * *